US005590438A

United States Patent [19]

Chen et al.

[11] Patent Number: 5,590,438

[45] Date of Patent: Jan. 7, 1997

[54] BRISTLED ARTICLE

[75] Inventors: Albert C. Chen, East Brunswick; Peter Hrinko, Jr., Fair Lawn; Kevin G. Yost, Short Hills, all of N.J.; John R. Kent, Yardley, Pa.

[73] Assignee: Johnson & Johnson Consumer Products, Inc., Skillman, N.J.

[21] Appl. No.: 509,005

[22] Filed: Jul. 27, 1995

Related U.S. Application Data

[63] Continuation of Ser. No. 311,237, Sep. 23, 1994, abandoned, which is a continuation of Ser. No. 798,362, Nov. 21, 1991, abandoned.

[51] Int. Cl.[6] ..... A46B 9/04

[52] U.S. Cl. ..... 15/167.1; 15/191.1; 15/195

[58] Field of Search ..... 15/190, 191.1, 15/195, 167.1; 300/21

[56] References Cited

U.S. PATENT DOCUMENTS

| | | | |
|---|---|---|---|
| 1,879,103 | 9/1932 | Connor | 15/190 |
| 1,919,010 | 7/1933 | Connor | 15/190 |
| 1,919,011 | 7/1933 | Connor | 15/190 |
| 2,409,490 | 10/1946 | Jobst | 15/190 |

FOREIGN PATENT DOCUMENTS

| | | | |
|---|---|---|---|
| 156802 | 4/1904 | Germany | 15/190 |
| 2227985 | 12/1973 | Germany . | |
| 232148 | 4/1925 | United Kingdom | 15/190 |
| 266618 | 3/1927 | United Kingdom | 15/190 |

OTHER PUBLICATIONS 2,007,500 UK Patent Application Great Britian Hahn.
2,182,239 UK Patent Application Great Britian Iwase.
237,653 European Patent Applicatioin Boucherie.

*Primary Examiner*—Patrick Brinson

[57] ABSTRACT

The present invention relates to an improved bristled article and more particularly to an improved toothbrush which has a tuft cavity with a cross-sectional area that decreases such that the tuft cavity is broadest at the open top end and becomes narrower toward the closed bottom end of the tuft cavity. This decrease of the breadth of the tuft cavity results in a greater packing factor in the closed bottom end portion of the cavity than in the open top end and provides higher bristle retention force.

5 Claims, 4 Drawing Sheets

BRISTLED ARTICLE

This is a continuation of application Ser. No. 08/311,237, filed Sep. 23, 1994, which is a continuation of Ser. No. 07/798,362, filed Nov. 21, 1991, both of which are now abandoned and hereby incorporated by reference.

BACKGROUND OF THE INVENTION

1. Field of the Invention

The present invention relates to an improved bristled article and more particularly to an improved toothbrush. The bristled article has a tuft cavity wherein the cross-sectional area of the tuft cavity decreases such that the tuft cavity is broadest at a surface contiguous to an open top end of the cavity and narrows toward a bottom closed end of the tuft cavity. With all other components left unchanged, this decrease of the breadth of the tuft cavity results in a greater packing factor and therefore better bristle retention in the smaller closed bottom end portion of the cavity. The bristled articles embodied in this invention include toothbrushes, hairbrushes, clothes brushes, industrial brushes, brooms, copier brushes, mascara applicators and the like.

2. Description of the Related Art

Bristled articles of the related art may be produced by injecting a thermoplastic material into a mold to form an article base, and subsequently mechanically anchoring the article base with tufts of bristles.

A potential problem with bristled articles of the related art described above is that the bristles may loosen or fall out of their tuft cavities. The effectiveness of the bristled article is thereby decreased. Loss of bristles from a tuft cavity reduces the number of exposed bristle ends and available effective surface. Further, loss of bristles in a tuft cavity reduces how tightly and securely the remaining bristles are retained in the cavity. In addition to lowering efficacy of these articles, loss of bristles reduces the convenience with which such bristled articles can be used. Understandably, users prefer not to use articles which leave stray bristles behind after use.

Some types of toothbrush bristles historically have greater tendency for bristle fall out and therefore need increased bristle packing to improve bristle retention. Different diameters of bristles are used by those skilled in the art to achieve a range of textures in toothbrushes. Toothbrushes have bristles ranging from 0.003 inch to 0.012 inch in diameter, more commonly from 0.005 inch to 0.012 inch. Individual bristle fallout is more likely to occur in toothbrushes with small diameter bristles or an insufficient number of bristles in a tuft.

Attempts to reduce the incidence of loose bristles in the brushes of the related art have not been wholly successful. One such approach involves the insertion of increased numbers of bristles into each tuft cavity of the bristled article. A serious attendant problem with this approach is that splaying of the bristles occurs when too many bristles are crowded into a tuft cavity creating an undesirable "bushy" appearance conveying a perception of a defective or worn brush.

It is an object of the invention to provide such a bristled article having a tuft cavity configuration that increases retention of the anchored bristles without attendant splay.

With the above and other objects in view, the present invention comprises the combination and arrangement of parts hereinafter more fully described, illustrated in the accompanying drawings and more particularly pointed out in the appended claims, it being understood that changes may be made in the form, size, proportions, and details of construction without departing from the spirit or advantages of the invention.

SUMMARY OF THE INVENTION

In accordance with the present invention a bristled article is provided comprising a plurality of bristles or filaments that are folded into tufts, and having at least one or more tuft cavities in a base that has a surface contiguous to an open top end of each tuft cavity. When filaments are inserted into the tuft cavity they form approximately U-shaped bristles having two free ends and a portion in between the two ends that is placed inside the tuft cavity. An anchoring means holds the tufted bristles together inside the tuft cavity. The free ends of the tufted bristles remain outside of the tuft cavity wherein the cross-sectional area of the tuft cavity decreases in such a way that the tuft cavity is broadest at the surface contiguous to the open top end of the cavity and narrows in a step towards a closed bottom end of the cavity at a point in the tuft cavity that will effectively prevent splaying of the free ends of the tufted bristles.

In a preferred embodiment of the bristled article, the tuft cavity narrows in step at a point 20% to 65% of the depth of the cavity. The cross-sectional area of the tuft cavity remains constant above the step and remains constant at a smaller value below the step.

In a more preferred embodiment of the bristled article the cross-sectional area of the top one-third of the depth of the tuft cavity remains constant and the cross-sectional area of the remaining two-thirds of the tuft cavity decreases in a step so that the cross-sectional area of a closed bottom end portion of the cavity is less than the cross-sectional area of an open top end portion of the remaining two-thirds of the cavity.

The bristled article of a preferred embodiment is a toothbrush that has a base that has a long handle. Also the mechanical means of securing the bristles in the cylindrical tuft cavity is an anchor, and the diameter of the closed end portion of the tuft cavity decreases in a step by about 2 to 20%. In another preferred embodiment the cross-sectional area of the tuft cavity decreases by 2% to 20% by tapering over a portion that is from 0% to 30% of the depth of the cavity. In a preferred embodiment the packing factor in the narrower portion of the tuft cavity is greater than that of the upper wider portion. Packing factor is defined as the sum total cross-sectional areas of the bristles in the tuft cavity divided by the tuft cavity cross-sectional area, excluding the area of the anchoring means.

As embodied and described herein the invention further comprises a method for making a toothbrush with a plurality of bristles anchored in a toothbrush head, with improved bristle and tuft retention comprising the steps of: tufting a plurality of bristles; dispersing the tufted bristles in a tuft cavity in the toothbrush head; and anchoring the tufted bristles by anchoring means that hold the plurality of tufted bristles together inside the tuft cavity while the free ends of the tufted bristles remain outside of the tuft cavity. The bristle and tuft retention of the toothbrush is improved by narrowing the cross-sectional area of said tuft cavity so that said tuft cavity is broadest at the surface contiguous to the open top end of said cavity and narrows toward a closed bottom end of said cavity. Furthermore, the narrowing of the cross-sectional area of said tuft cavity is effective to minimize splaying of the free ends of the tufted bristles.

BRIEF DESCRIPTION OF THE DRAWINGS

FIG. 7 is a square configuration;

FIG. 8 is a rectangular configuration;

FIG. 9 is a hexagonal configuration;

FIG. 10 is an oval configuration; and

FIG. 11 is a rhomboidal configuration;

FIG. 12 shows a straight sided open end portion of the tuft cavity and a tapered closed end portion;

FIG. 13 shows a straight sided open end portion of the tuft cavity joined to a tapered closed end portion by a step;

FIG. 14 shows a straight sided open end portion of the tuft cavity joined to a tapered closed end portion by another tapered portion; and FIG. 15 shows a straight sided open end portion of the tuft cavity joined to a straight sided closed end portion by a tapered portion.

DETAILED DESCRIPTION OF THE PREFERRED EMBODIMENTS OF THE INVENTION

Reference will now be made in detail to the present preferred embodiments of the invention examples of which are illustrated in the following Examples section. The preferred embodiments are conveniently described by reference to the accompanying FIGS. 1–15. The step in all of the figures is exaggerated for purposes of clarity.

Figure 1:
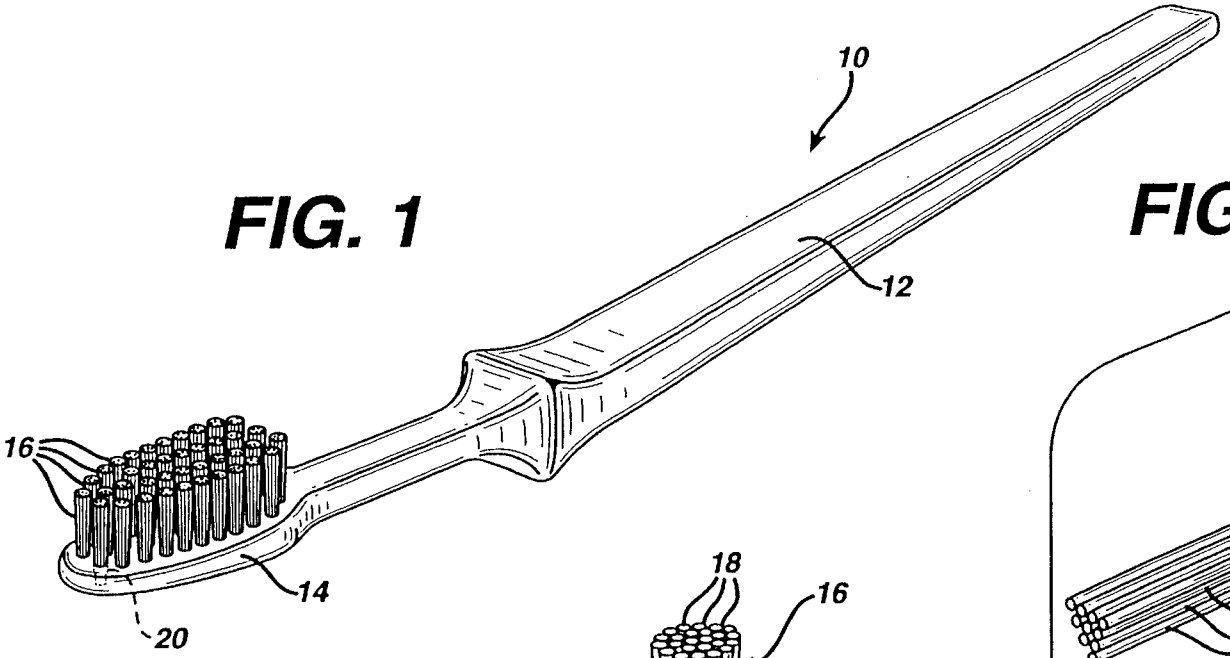
FIG. 1 is a perspective view of a toothbrush which is an embodiment of this invention.

FIG. 1 illustrates a toothbrush 10 of an embodiment of this invention. Handle 12 (which may be composed of various plastic polymers including polypropylene, cellulosics, polyesters, and acrylics, or wood and other suitable substances) is attached to the toothbrush head 14 which preferably has a plurality of tuft cavities 20.

Figure 3:
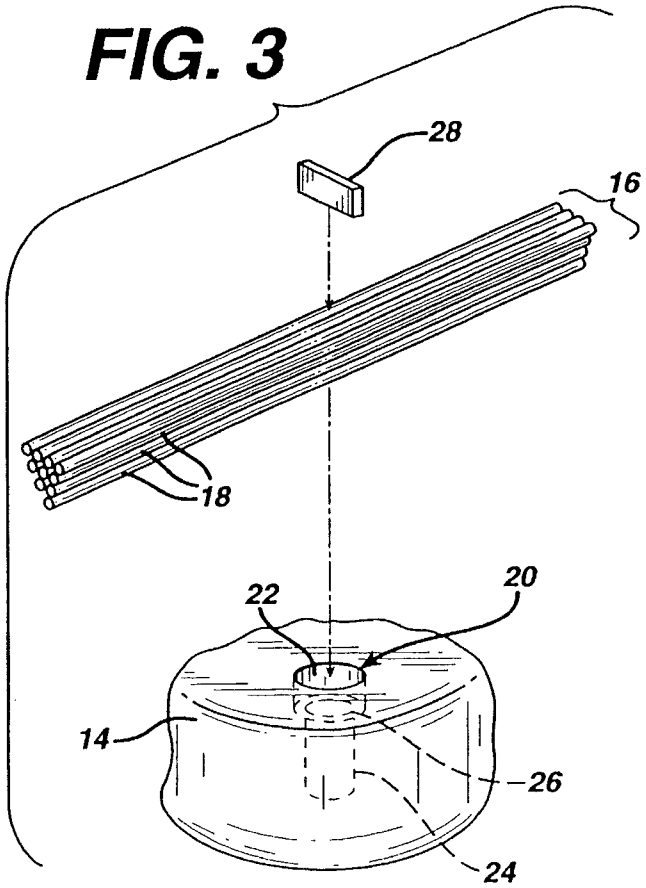
FIG. 3 is an exploded perspective view showing the bristles and base prior to insertion of the bristles.
Figure 2:
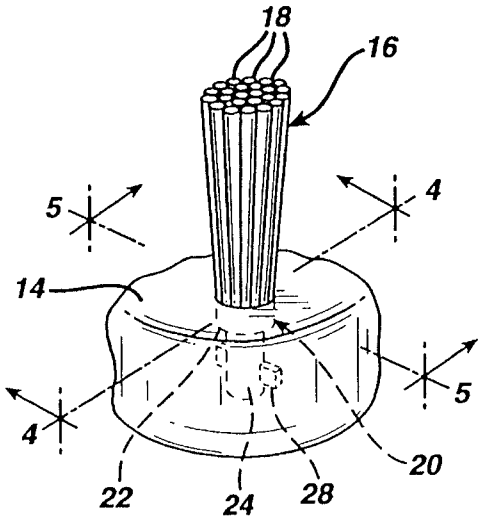
FIG. 2 is a fragmentary perspective view of one group of bristles in a preferred embodiment of this invention.

As can be seen in FIGS. 2 and 3 a cylindrical tuft cavity 20 contains a tuft 16 of a plurality of bristles 18 (which may be composed of various plastic materials including polyamides, polyolefins, polyesters or natural fiber materials such as animal hair). The tuft cavity has an open end 22 and a closed end 24. The tuft cavity is cylindrical and has a hemispherical closed bottom end in a preferred embodiment. The schematic diagrams of FIGS. 6–11 illustrate some alternative embodiments of tuft cavities. The product of this invention is in no way limited to the exemplary shapes illustrated. Other useful product shapes known to those skilled in the art may also be used in accordance with the present invention. For example, the shapes of the closed bottom end may be hemispherical, chamfered, conical, flat, or flat with some texture or raised surface on it such as a crossed spline.

FIG. 3 illustrates that the decrease in diameter between closed bottom end 24 and open top end 22 occurs in a step 26. The arrow entering open top end 22 shows how the bristles 18 are inserted into the tuft cavity 20. Likewise, the arrow touching the tuft 16 shows the direction in which an anchoring means 28 is inserted into the tuft cavity to press-part of the individual bristles 18 toward the closed bottom end 24 of the tuft cavity so that the bristles 18 will be unlikely to be dislodged from the tuft cavity 20. Optimum anchoring, as known by those skilled in the art, requires careful control of anchor depth, diameters of portions of the hole, and the number of bristles in the hole to achieve the desired packing factor previously described. Within the limits of good manufacturing, a high level of bristles in the tuft cavity, achieving a high packing factor, will increase the likelihood the bristles will not become loose and separate from the tuft.

The anchoring means 28 illustrated in FIG. 3 is a fastener that may consist of metal, plastic, wood, or any variety of synthetic or natural materials. Like the tuft cavity there are many other alternate embodiments of the anchor that are encompassed by the product of this invention. Also, many different sizes of anchoring means 28 will be acceptable.

Figure 4:
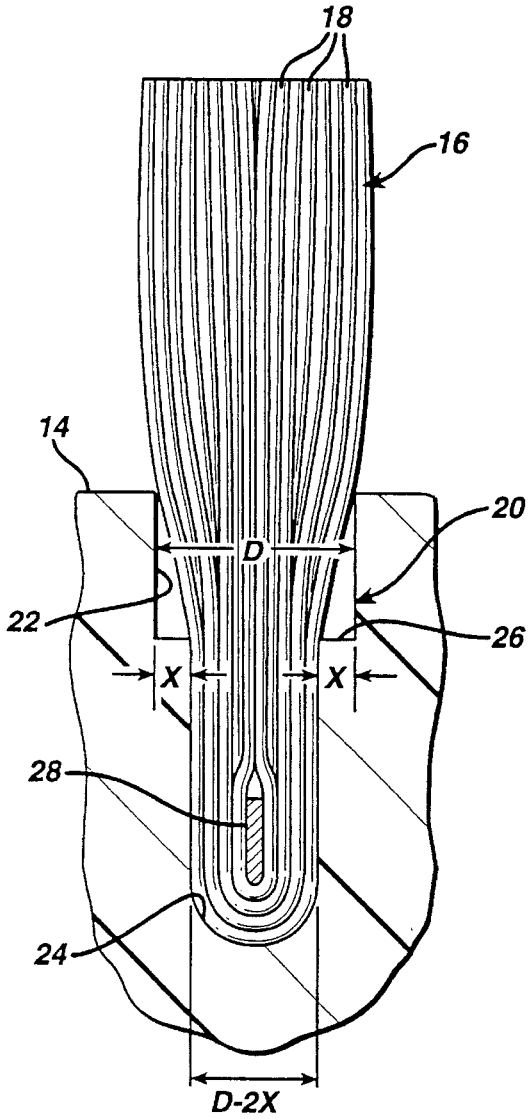
FIG. 4 is an enlarged cross-sectional view taken along line 4—4 of FIG. 2 and perpendicular to the anchor showing the straight sided open end portion of the tuft cavity connected to a straight sided closed end portion by a step.
Figure 5:
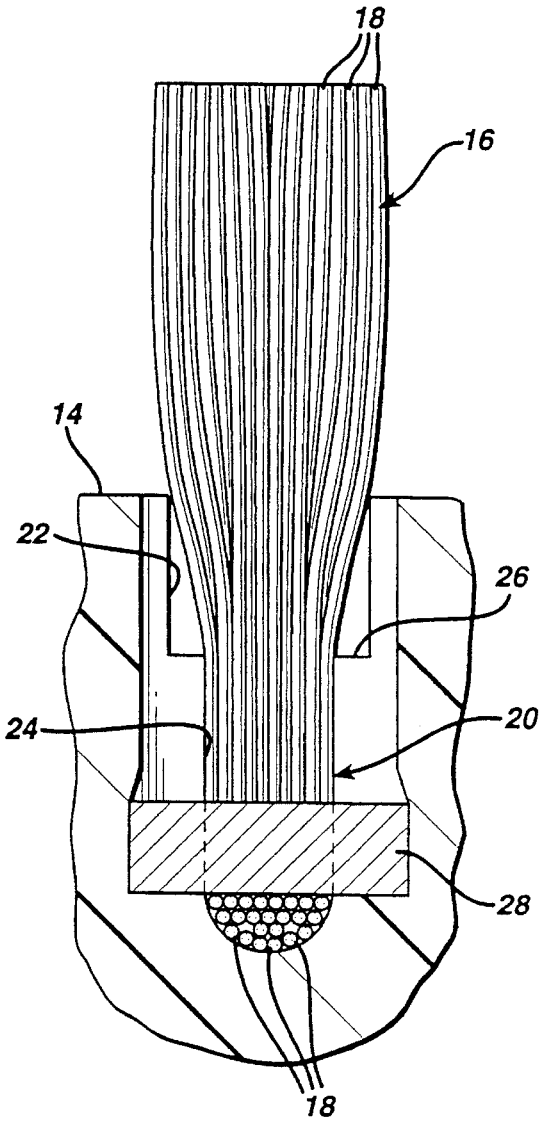
FIG. 5 is an enlarged cross-sectional view taken along line 5—5 of FIG. 2 parallel to the anchor and perpendicular to the bristles passing under it showing the same type of cavity as FIG. 4.
Figure 6:
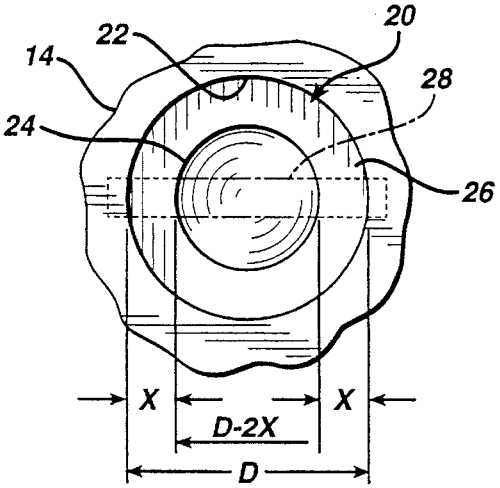
FIG. 6 is a top plan view of the tuft cavity of the preferred embodiment depicted in FIG. 3—without the bristles shown.

The splaying prevention feature of these products is accomplished by a step 26 in the cavity 24 that can be seen in the schematic diagrams in FIG. 4 and FIG. 5. In FIG. 4 the diameter D of the wider open top end 22 of the tuft cavity 20 is wider than the diameter of the closed bottom end 24. The bristles 16 may expand into open top end portion 22 before their free ends are exposed beyond the surface contiguous to the open top end 22.

The tuft cavity 20 is designed with a smaller cross-sectional area at the closed bottom end 24 so the bristles 18 are optimally packed in the tuft cavity 20 and around the anchoring means 28. As a result, individual bristles 18 are unlikely to come loose from the closed bottom end 24 of the tuft cavity 20. A larger cross-sectional area is provided at the top end 22 so that the tuft of bristles 18 does not have undesirable splay but remains together as a parallel and closely grouped aggregate.

Figure 7:
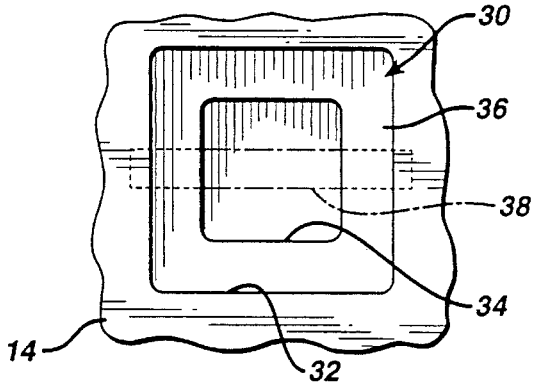
FIGS. 7 through 11 show alternative embodiments of the tuft cavity which can be employed by the principles of this invention.
Figure 8:
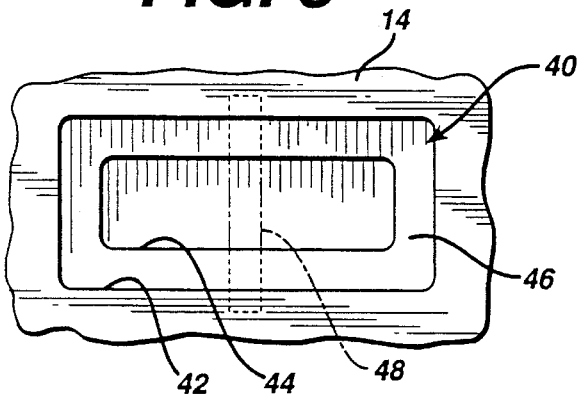
Figure 9:
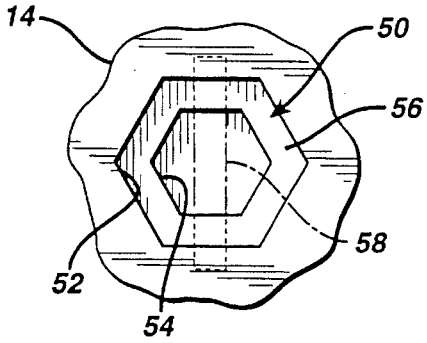
Figure 10:
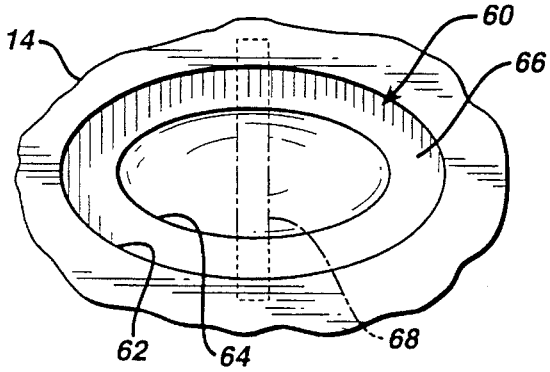
Figure 11:
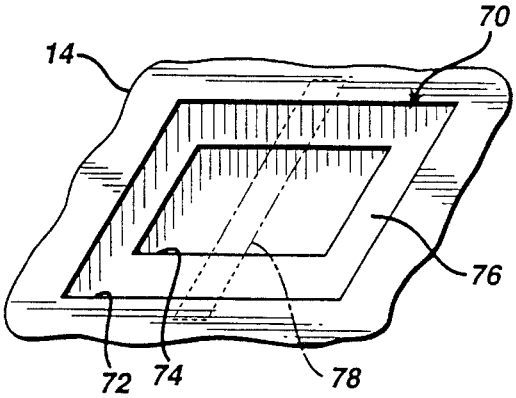
Figure 12:
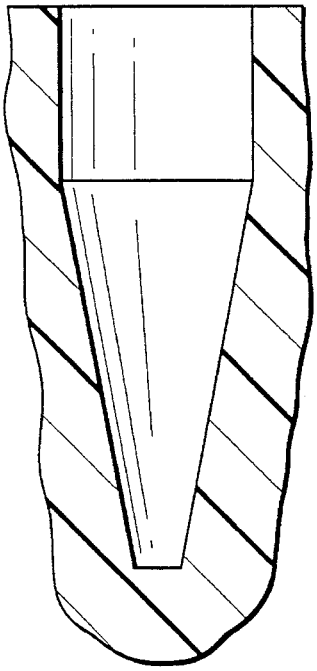
FIGS. 12 through 15 show alternative cross-sectional tuft cavity shapes.
Figure 13:
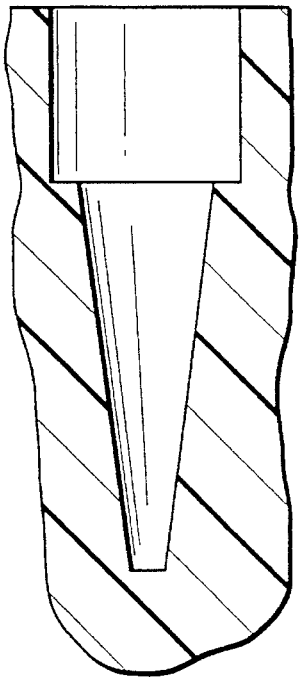
Figure 14:
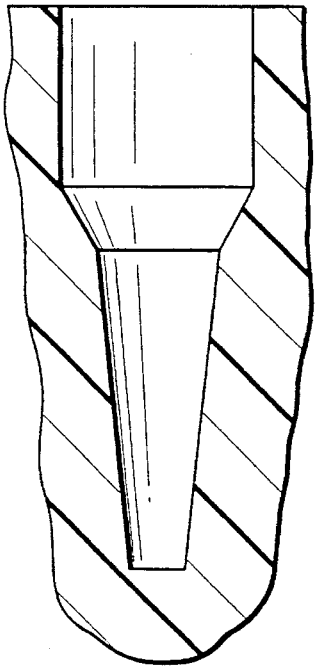
Figure 15:
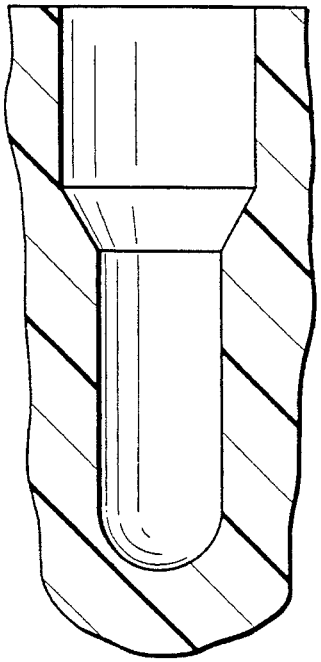

The distance "x" does not have to be of equal length throughout the tuft cavity as it is in FIG. 4. In FIG. 7, for example, step 36 between the open top end 32 and closed bottom end 34 does not have to be the same for all four sides and may have up to four different lengths. This applies to the embodiments in FIGS. 8 through 11 as well. Similarly, in FIG. 9 step 56 between open top end 52 and closed bottom end 54 can be different along each respective side of the hexagon. Embodiments of tuft cavities with straight sides such as tuft cavities 30, 40, 50, and 70 may have as many different sizes of steps as they have sides along the open and closed ends. The steps do not have to be uniform in circular and elliptical embodiments either (i.e. FIGS. 2, 3, 6, and 10) because the closed end may be positioned closer to one portion of the wall of the open end.

Referring to any of FIGS. 2–5, it is essential that the diameter of the open top end 22 be greater than the diameter of the closed bottom end 24. It is inconsequential whether the step is symmetrically or asymmetrically juxtaposed between the "X" open top and closed bottom end. Preferably, the decrease in step width is about 2 to 20 percent of the diameter as illustrated in the preferred embodiments of FIGS. 4, 5 and 6. The step does not necessarily have to fall within this preferred range, rather the step change in width should be of an amount effective to significantly increase packing factor and retention of bristles while minimizing any splaying effects herein.

As illustrated below, as the packing factor in the closed bottom end of the tuft cavity is increased the bristle removal force is also increased. Greater bristle removal force means the bristles are more likely to be retained in the tuft cavity.

EXAMPLES

The invention will now be illustrated by Examples. The Examples are not intended to be limiting of the scope of the present invention, but read in conjunction with the detailed and general description above, provide further understanding of the present invention, and an outline of a process for preparing the toothbrush and other bristled articles of the invention.

Toothbrushes in accordance with the invention are made by conventional molding processes of preparing bristled articles known in the art except they employ a distinctive core pin shape that is broadest at the open top end portion of the pin and narrows in a step toward the closed bottom end portion of the pin to form the appropriate tuft cavity.

The handle material used may be any injection moldable polymer such as polypropylene or cellulose acetate propionate. The polymer is processed in an injection molding machine by heating (melting), injecting under pressure into a mold and then cooling until rigid. The polymer is forced into the mold cavity or cavities which contain precisely formed core pins in a specific pattern. The cooled plastic handle or article replicates the cavity/core pin configuration.

When toothbrushes are being prepared, toothbrushes bristles are inserted into the molded polymer handle utilizing conventional bristling equipment (e.g. Boucherie, Zahoransky or Evans machines). Other types of mechanical anchoring-bristling equipment are also suitable and can be applied in compliance with conventional methods to produce toothbrushes in accordance with the invention.

Examples below illustrate that bristled articles of this invention have greater bristle retention force than known bristled articles. The tuft cavities of the following toothbrush samples are cylindrical and are 0.150 inches deep.

To determine bristle and tuft retention these examples were subjected to force of removal tests utilizing conventional force testing equipment, e.g. the Instron Universal Testing Machine. The test procedure is as follows: at one end an operator places the toothbrush in the machine so that the toothbrush is held by a holding device such as a jig while a hemostat or other clamping means is positioned above the toothbrush so that it pulls a bristle until it is completely removed from the tuft cavity. The operator chooses an outer bristle to clamp in the hemostat. As illustrated in FIG. 4, bristles that are closer to the anchoring means have a narrower closed end portion than bristles that are closer to the walls of the tuft cavity. Bristles that are closer to the tuft cavity walls than to the anchor (wide-bend bristles) have a wider shaped U than bristles that are closer to the anchor (narrow-bend bristles). The operator chooses bristles farther from the anchor because they are more likely to become loose than the bristles closer to the anchor that have a tighter bend at the closed bottom end portion.

Removing bristles with a wider bend requires less force and therefore these are the bristles of interest.

After the operator chooses a bristle with a wider bend to be clamped, the Instron machine pulls the bristle until it comes out of the tuft cavity. The operator records the data regarding that bristle. The test is performed on only one wide-bend bristle in each tuft cavity since as bristles are removed from the tuft cavity the packing factor, and therefore the bristle removal force decreases. The bristle retention force discussed in the Examples refers to the single bristle removed from each tuft cavity.

Toothbrush bristles with diameters of 0.006, 0.007, and 0.010 inch were placed within tuft cavities 0.150 inch deep, and therefore required a bristle removal force in the range of about 150 to 200 grams to remove a bristle from each tuft cavity. The mean bristle retention forces ranged from 74±19 grams to over 356±159 grams. In order to increase the packing factor in the closed bottom end portion of the tuft cavity and prevent splaying of the free ends of the bristles beyond the surface contiguous to the open top end portion, the diameter of the open top end portion of the 0.150 inch deep tuft cavity was 0.073 inches while the diameter of the closed bottom end portion of the tuft cavity was 0.069 inches.

The bristle retention forces are reported as the mean±standard deviation for ten samples. The effect of packing factor in the current invention on bristle removal force is illustrated in the following examples.

Current Practice Example 1

These examples are presented to show the effect of current practice for comparison to the present invention. Toothbrushes produced according to current practice have tuft cavities with uniform diameters from the open top ends to the closed bottom ends. Tuft cavities of toothbrushes of this Example with uniform diameters of 0.073 inches and hemispherical closed bottom ends containing bristles of 0.010 inch diameter have a packing factor of 0.68 and mean bristle removal force of 103±18 grams.

Current Practice Example 2

This example is produced according to the procedure of Current Practice Example 1 having tuft cavities of a uniform 0.073 inch diameter and hemispherical closed ends. Bristles with a diameter of 0.006 inch placed in the tuft cavities to achieve a packing factor of 0.65 show bristle retention forces of 69±36 grams. Bristles with diameters of 0.007 inch and a packing factor of 0.67 show measured bristle retention force to be 88±45 grams.

Example 1

The tuft cavities of Example 1 have hemispherical closed bottom ends with a 0.073 inch diameter over the top one-third of the cavities and a 0.069 inch diameter over the remaining bottom two-thirds of the cavities. The packing factor of the open top end portion of the cavity is 0.68, however, the packing factor of the closed bottom end portion is 0.77 and the bristle removal force mean of the ten sampled 0.010 inch bristles is 272±67 grams. The difference between the bristle removal force mean of this Example and of Current Practice Example 1 discussed previously is significant. Despite the larger bristle removal force of this example, splaying of the free ends of the tufted bristles was avoided.

Example 2

This Example as well as Example 3 is carried out according to the same general procedure of Example 1. Like Example 1, the diameter of the open top end portion is 0.073 inch and the diameter of the closed bottom end portion is 0.069 inch. Unlike Example 1 the closed bottom end shape is flat. While the packing factor of the closed bottom end portion of this configuration is the same (0.77) as the one for Example 1, the bristle removal force mean (184±37 grams) is not as high, but still much larger than the bristle removal force mean of Current Practice Example 1, and again undesirable splaying was avoided.

Example 3

This Example is produced according to the procedure of Example 1. In order to calculate the mean bristle removal force for the 0.006 inch and 0.007 inch bristles, force testing was performed on ten tuft cavities of each type of bristle.

Wide-bend 0.006 inch bristles having a packing factor of 0.74 within a tuft cavity of 0.069 inch diameter along the entire depth of the cavity (0.004 inch smaller than the diameter of the tuft cavity described previously) have a mean bristle removal force of 156±68 grams when the closed bottom end is hemispherical, Wide-bend 0.007 inch bristles inserted into a tuft cavity having a diameter of 0.069 inch along the entire depth of the cavity and achieving a packing factor of 0.76 have a mean bristle removal force of 156±77 grams. In comparing these values to those of Current Practice Example 2, the improvement in bristle retention force with increased packing factor is seen.

Packing factor is increased in the Examples by narrowing the diameter of the closed bottom two-thirds of the tuft cavities in a step. The examples also show that smaller diameter fibers characteristically have lower bristle retention forces.

The improvement in bristle retention achieved by the present invention is observed by comparing the increase in retention force for 0.010 inch bristles from 103 grams in the uniform diameter tuft cavities of Current Practice Example 1 and the 272 grams in the stepped tuft cavities of Example 1. A more important change is seen with the smaller diameter bristles of Current Practice Example 2 showing an increase in retention force from 69 grams and 88 grams to 156 grams in the stepped holes of Example 3. These show an increase to greater than 170% of the original bristle retention forces for these bristle sizes. These increases are achieved through an increased packing factor allowed by the stepped hole design.

Increasing the packing factor had more of an effect upon bristle retention force than did different shapes of the closed bottom end of the tuft cavity. For example, the difference between the bristle retention force values of Example 1 (hemispherical closed bottom end) and those of Example 2 (flat closed bottom end) is not significant.

By tapering the diameter from the broadest open top portion to the narrower closed bottom end portion one increases packing factor. However, undesirable splaying is not prevented as well by a configuration of this sort as by one which has a step decrease in diameter from the open top end portion to the closed bottom end portion of the tuft cavity. In toothbrushes, tapering the diameter from the broadest open top portion to the narrower closed bottom end portion is probably not desirable because of potential splaying, but for other applications it may be favored. For example, a broom containing bristles that splay covers more floor space than a broom containing bristles that do not splay. In such cases, i.e. brooms, more area can be cleaned faster with a tool that has splayed bristles. FIGS. 12–15 illustrate some different tuft cavities that have tapered portions.

The scope of the present invention is not limited by the description, examples and suggested uses herein, and modifications can be made without departing from the spirit of the invention. For example, the stepped cavities of the invention may be utilized for producing other bristled consumer items, e.g. hairbrushes, brooms, scrub brushes etc. and the above examples delineate a variety of closed bottom end shapes that are not meant to encompass all of the shapes that may also be used in accordance with the present invention.

Application of the methods of the present invention can be accomplished by any extruding, injection molding, anchoring, bristling and product forming methods and techniques as are presently or prospectively known to those skilled in the art. Thus it is intended that the present application cover the modifications and variations of this invention provided they come within the scope of the appended claims and their equivalents.

What is claimed is:

1. A toothbrush comprising:

(a) a plurality of bristles folded into tufts having free ends;

(b) at least one tuft cavity in a base having a surface contiguous to an open to end of said tuft cavity; and (c) an anchoring means that holds the plurality of tufted bristles together inside the tuft cavity and the free ends of the tufted bristles remain outside of the tuft cavity wherein the cross-sectional area of said tuft cavity decreases such that said tuft cavity is broadest at the surface contiguous to the open to end of said cavity and narrows toward a closed bottom end of said cavity in a way that is effective to prevent playing of the free ends of the tufted bristles, the cross sectional area of the tuft cavity occupied by the plurality of bristles as measured by the total cross-sectional area of the bristles in the tuft cavity divided by the cross-sectional tuft cavity area, excluding the anchoring means area, comprising a packing factor, said packing factor being greater in the narrower closed bottom end portion than the broader open top end portion of the tuft cavity.

2. The toothbrush of claim 1 wherein the packing factor in the narrower closed bottom end portion of the tuft cavity is greater than about 0.74.

3. The toothbrush of claim 2 wherein the packing factor is in the range of about 0.74–0.77.

4. A toothbrush comprising:

(a) plurality of bristles folded into tufts having free ends;

(b) at least one tuft cavity in a base having a surface condition open top end of said tuft cavity; and (c) an anchoring means that holds the plurality of tufted bristles together inside the tuft cavity and the free ends of the tufted bristles remain outside of the tuft cavity wherein the cross-sectional area of said tuft cavity decreases such that said tuft cavity is broadest at the surface contiguous to the open top end of said cavity and narrows toward a closed bottom end of said cavity in a way that is effective to prevent spaying of the free ends of the tufted bristles, said toothbrush having a bristle removal force comprising the necessary amount of force exerted upon a bristle to remove said bristle from the tuft cavity, said bristle removal force being greater than about 150 grams.

5. The toothbrush of claim 4 wherein the bristle removal force is in the range of about 150–200 grams.

* * * * *